US011348493B2

(12) United States Patent
Wriedt

(10) Patent No.: US 11,348,493 B2
(45) Date of Patent: May 31, 2022

(54) SIGNAGE HAVING INTERCHANGEABLE MAGNETIC ADVERTISING PANELS

(71) Applicant: BLUE HIPPO, LLC, Orlando, FL (US)

(72) Inventor: Bradley E. Wriedt, Windermere, FL (US)

(73) Assignee: BLUE HIPPO, LLC, Orlando, FL (US)

( * ) Notice: Subject to any disclaimer, the term of this patent is extended or adjusted under 35 U.S.C. 154(b) by 18 days.

(21) Appl. No.: 16/434,852

(22) Filed: Jun. 7, 2019

(65) Prior Publication Data

US 2019/0378443 A1 Dec. 12, 2019

Related U.S. Application Data

(60) Provisional application No. 62/681,773, filed on Jun. 7, 2018.

(51) Int. Cl.
*G09F 15/00* (2006.01)

(52) U.S. Cl.
CPC ..... *G09F 15/0018* (2013.01); *G09F 15/0012* (2013.01); *G09F 15/0037* (2013.01); *G09F 15/0062* (2013.01)

(58) Field of Classification Search
CPC ..... G09F 7/04; G09F 2007/1852; A47G 2001/0672
USPC ..... 40/711
See application file for complete search history.

(56) References Cited

U.S. PATENT DOCUMENTS 3,755,938 A * 9/1973 Bytwork ..... G09F 1/12 40/530
3,786,584 A * 1/1974 Holson ..... A47G 1/065 40/124
4,197,151 A * 4/1980 Muzik ..... B32B 27/18 156/249
4,531,320 A * 7/1985 James ..... G09F 7/04 335/303
4,976,055 A * 12/1990 Kane ..... G09F 1/12 248/206.5
4,999,937 A * 3/1991 Bechtold ..... G09F 15/0062 16/329

(Continued)

FOREIGN PATENT DOCUMENTS

FR 2654858 A1 * 5/1991 ..... G09F 7/04

*Primary Examiner* — Cassandra Davis
(74) *Attorney, Agent, or Firm* — Matthew G. McKinney; Allen, Dyer et al.

(57) ABSTRACT

A sign for displaying advertising includes a freestanding frame comprising a first side having a first planar surface, a first plate secured to the first side of the freestanding frame and over the first planar surface, and a first magnetic panel comprising a flexible material removably secured to the first plate using magnetic forces and having similar dimensions and a shape to the first planar front surface of the first side. In addition, the freestanding frame comprises a lower portion configured to support the sign in an upright orientation relative to a ground surface. A first protruding lip extends about a periphery of the first planar surface of the first side and around the first magnetic panel. The freestanding frame also includes a second side having a second planar surface, and the second side is hingedly secured along a top edge to the first side forming an A-frame sign.

15 Claims, 6 Drawing Sheets

(56) References Cited

U.S. PATENT DOCUMENTS 5,269,083 A * 12/1993 Vampatella ..... A47G 1/065 248/206.5
5,303,493 A 4/1994 Plumly
5,524,373 A * 6/1996 Plumly ..... G09F 7/04 40/600
5,737,862 A * 4/1998 Cooper ..... G09F 7/04 40/541
5,852,890 A 12/1998 Pynenburg
6,347,469 B1 2/2002 Huellinghoff et al.
6,432,520 B2 * 8/2002 Pynenburg ..... G09F 7/04 40/600
6,651,367 B1 * 11/2003 Barragan ..... G09F 7/00 116/63 P
6,821,593 B2 * 11/2004 Maggio ..... A47G 1/17 40/600
7,373,747 B1 * 5/2008 Wiemer ..... G09F 7/00 40/600
8,371,141 B2 * 2/2013 Richmond ..... A44C 27/00 63/29.2
9,934,702 B2 * 4/2018 Harshman ..... G09F 3/206
10,388,193 B1 * 8/2019 Wriedt ..... A47C 7/00
10,912,971 B2 * 2/2021 Wriedt ..... A63B 57/505
2001/0045037 A1 * 11/2001 Bank ..... G09F 7/04 40/621
2003/0221349 A1 * 12/2003 Abe ..... G09F 7/10 40/711
2004/0040195 A1 * 3/2004 Copley ..... A47G 1/0622 40/711
2005/0155265 A1 * 7/2005 Coleman-Chang ..... G09F 7/04 40/600
2005/0284011 A1 * 12/2005 Todd ..... G09F 7/04 40/600
2006/0143964 A1 7/2006 Chatellier et al.
2007/0099457 A1 * 5/2007 Beno ..... G09F 15/00 439/135
2008/0265082 A1 * 10/2008 Angiuli ..... A45F 5/004 242/400
2009/0123344 A1 5/2009 Dobler et al.
2012/0060398 A1 * 3/2012 Bowman ..... G09F 7/04 40/600
2015/0157126 A1 * 6/2015 Wang ..... A47C 7/62 297/188.04
2016/0088957 A1 * 3/2016 Makrakis ..... A47G 1/06 40/711
2016/0098945 A1 * 4/2016 Takemoto ..... B44C 1/10 40/711

* cited by examiner

SIGNAGE HAVING INTERCHANGEABLE MAGNETIC ADVERTISING PANELS

CROSS-REFERENCE TO RELATED APPLICATIONS

This application claims priority to U.S. Provisional Application Ser. No. 62/681,773 filed on Jun. 7, 2018, the contents of which are herein incorporated by reference in their entirety.

TECHNICAL FIELD

The present invention relates to the field of signage, and, more particularly, to signage having interchangeable magnetic advertising panels.

BACKGROUND

Various types of signs are widely used in restaurants, hotel pool decks, lounges, and other similar commercial locations. Accordingly, many people pass through these areas every day, providing a unique opportunity to display advertising and information.

Often times signs may be placed in a case or frame at an entrance to a restaurant in order to display the menu so that patrons can decide whether to enter the restaurant. The signs are designed to attract the attention of the public and therefore provide a valuable opportunity to provide advertisements or other pertinent information. However, the signs are displayed on a wall and not within the foot traffic pattern.

Free standing signs are designed to be placed proximate the foot traffic pattern so that as patron walk past they will view the sign. These freestanding signs are typically for a single purpose such as to indicate a hazardous condition. For example, the sign may display "Caution, Floor Slippery When Wet." However, these types of signs are not designed to display more than one messages or other types of information. Thus, there is a need in the art for a device that increases the visibility of the sign that can be placed within the foot traffic pattern and is adaptable to display different information or display material.

SUMMARY

In view of the foregoing background, it is therefore an object of the present invention to provide an improved sign for displaying advertising using interchangeable magnetic panels. The sign includes a freestanding frame comprising a first side having a first planar surface, a first plate secured to the first side of the freestanding frame over the first planar surface, and a first magnetic panel comprising a flexible material removably secured to the first plate using magnetic forces and having similar dimensions and a shape to the first planar front surface of the first side. The freestanding frame also includes a lower portion that is configured to support the sign in an upright orientation relative to a ground surface.

The sign may also include a first protruding lip extending about a periphery of the first planar surface of the first side and around the first magnetic panel, and the first plate may comprise steel.

In addition, the freestanding frame may include a second side having a second planar surface, where the second side is hingedly secured along a top edge to the first side forming an A-frame sign. A second plate may be secured to the second planar surface of the second side, and comprise steel. A second magnetic panel comprising a flexible material may be removably secured to the second plate using magnetic forces, where the second magnetic panel has similar dimensions and a shape to the second planar surface. The sign may also include a second protruding lip extending about a periphery of the second planar surface of the second side and around the second magnetic panel.

A respective bottom edge of the first and second sides may be configured to be spaced a distance apart causing the first and second magnetic panels to be displayed at an angle relative to the ground surface.

In another particular aspect, a method of making a sign for displaying advertising is disclosed. The method includes forming a freestanding frame having a first side and a first planar surface thereon, and securing a first plate to the first side of the freestanding frame over the first planar surface. In addition, the method includes removably securing a first magnetic panel to the first plate using magnetic forces and having similar dimensions and a shape to the first planar front surface of the first side.

The method may also include forming a first protruding lip about a periphery of the first planar surface of the first side, and forming the freestanding frame having a second side and a second planar surface thereon. In addition, the method may include forming a second protruding lip about a periphery of the second planar surface of the second side, securing a second plate to the second side of the freestanding frame over the second planar surface, and removably securing a second magnetic panel to the second plate using magnetic forces and having similar dimensions and a shape to the second planar surface of the second side.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
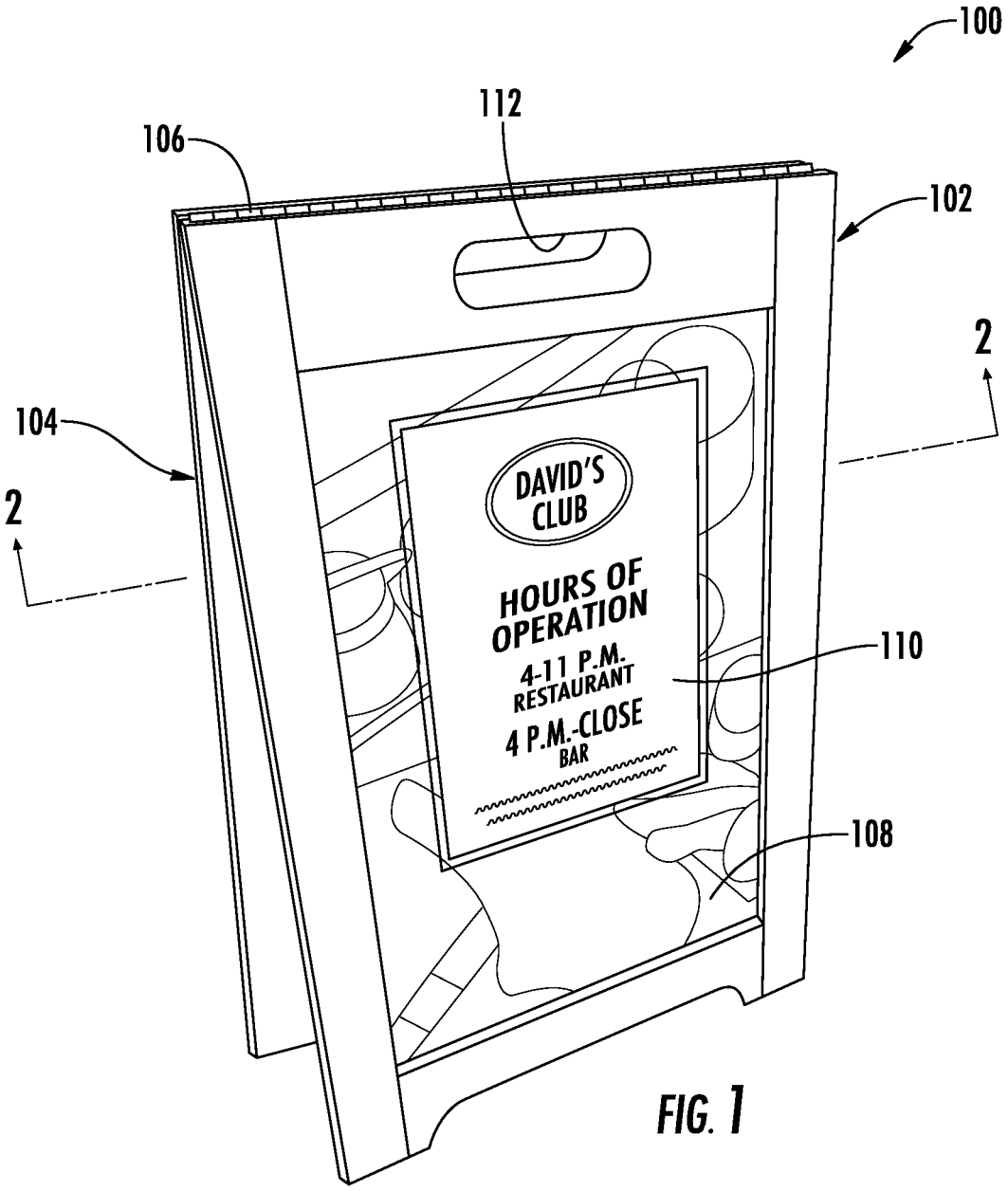
FIG. 1 is a front perspective view of an A-frame freestanding sign having interchangeable magnetic panels in accordance with a particular aspect of the invention.

Referring now to FIG. 1, a particular illustrative embodiment of an A-frame sign having interchangeable magnetic panels is disclosed. The A-frame sign 100 includes a freestanding frame 105 comprising a first side 102 having a first planar surface that is configured to receive a magnetic panel 108 that is interchangeable. The magnetic panel 108 generally has similar dimensions and a shape to the front surface of the first side 102 and may include advertising information. A plastic sleeve 110 may also be secured to the magnetic panel 108 in order to display a piece of paper having additional information, such as "Today's Special", or "Hours of Operation", for example.

Figure 2:
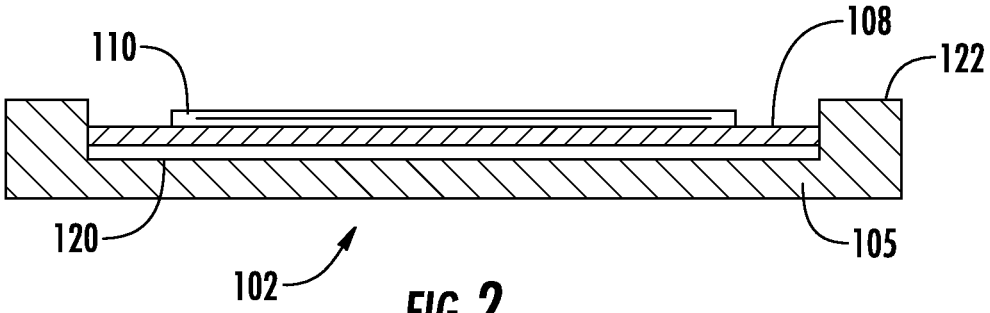
FIG. 2 is a cross sectional view taken in the direction of line 2-2 of FIG. 1.

A periphery of the front surface of the first side 102 of the sign 100 has a protruding lip 122 that extends around the magnetic panel 108, as best illustrated in FIG. 2. Accordingly, the protruding lip 122 serves to provide a border and to accentuate the magnetic panel 108. The magnetic panel 108 may have decorative graphics and advertisement information displayed thereon.

A second side 104 of the A-frame sign 100 may be constructed substantially identical to the first side 102, or may not have the same features as the first side 102. As shown in FIG. 1, the second side 104 is hingedly secured to the first side 102 along a top edge 106. Accordingly, when a bottom edge of the first side 102 and the second side 104 are moved a distance apart, the sign 100 forms an "A" shape causing the magnetic panel 108 of each respective side to be displayed at an angle relative to the ground surface. The sign 100 may also include hand holds 112 that are used to easily carry the sign 100 for transport and placement.

A cross sectional view of a portion of the A-frame sign 100 is shown in FIG. 2. The magnetic panel 108 comprises magnetic properties with a first polarity and is configured to removably adhere to a plate 120 having a second polarity. The plate 120 is integrated within the front surface of the first side 102 and may be screwed to the first side 102 or otherwise secured thereto. In a particular embodiment, the plate 120 has a thickness of approximately 0.0625 inches (16*ga*) and comprised of steel that is painted to match the first side 102. The plate 120 may also be of any thickness, such as 0.125 inches (11*ga*), for example, depending on the particular application as can be appreciated by those of ordinary skill in the art. The first side 102 may be comprised of HDPE plastic, wood, or any other material suitable for commercial signage.

Figure 3:
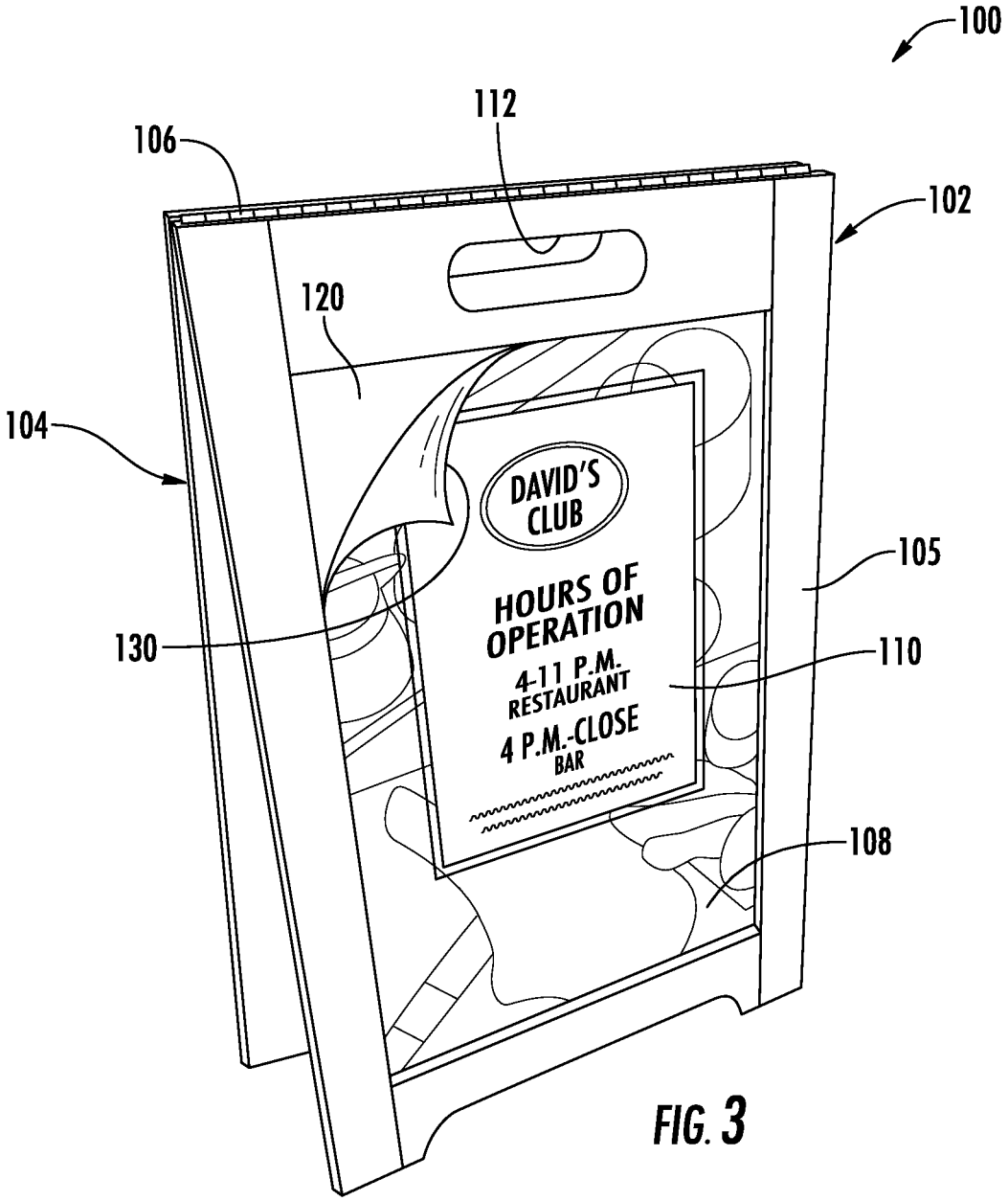
FIG. 3 is a perspective view of the freestanding sign with an interchangeable magnetic panel being partially removed.

The magnetic panel 108 is comprised of a flexible material and can be peeled off the plate 120 by grasping an edge 130 and pulling as illustrated in FIG. 3. Another magnetic panel 108 can then be placed back on the plate 120 to display the desired graphics printed thereon such as advertising.

The magnetic panel 108 may be reversible so that a side that is facing outwards and exposed to the weather can be reversed and the opposing second side can then be displayed. In some cases both sides may have identical graphics so that when one side is worn, the other can be displayed. Alternatively, the opposing sides may have different graphics.

Figure 4:
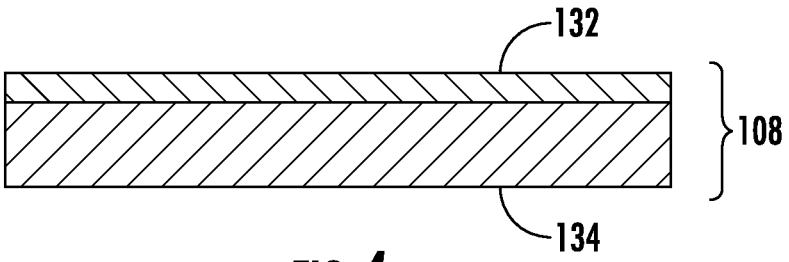
FIG. 4 is a cross sectional view of the interchangeable magnetic panel.

A cross section of the magnetic panel 108 is shown in FIG. 4. The magnetic panel 108 is comprised of a flexible material. In a particular embodiment, the magnetic panel 108 has a laminated vinyl layer 132 and an underlying magnetic layer 134 having a second polarity. The vinyl layer 132 and the magnetic layer 134 have similar size, shape, and dimensions. In a particular aspect, the magnetic layer 134 has a thickness of 0.03 inches, and the vinyl layer 132 has a thickness of 0.045 inches.

Figure 5:
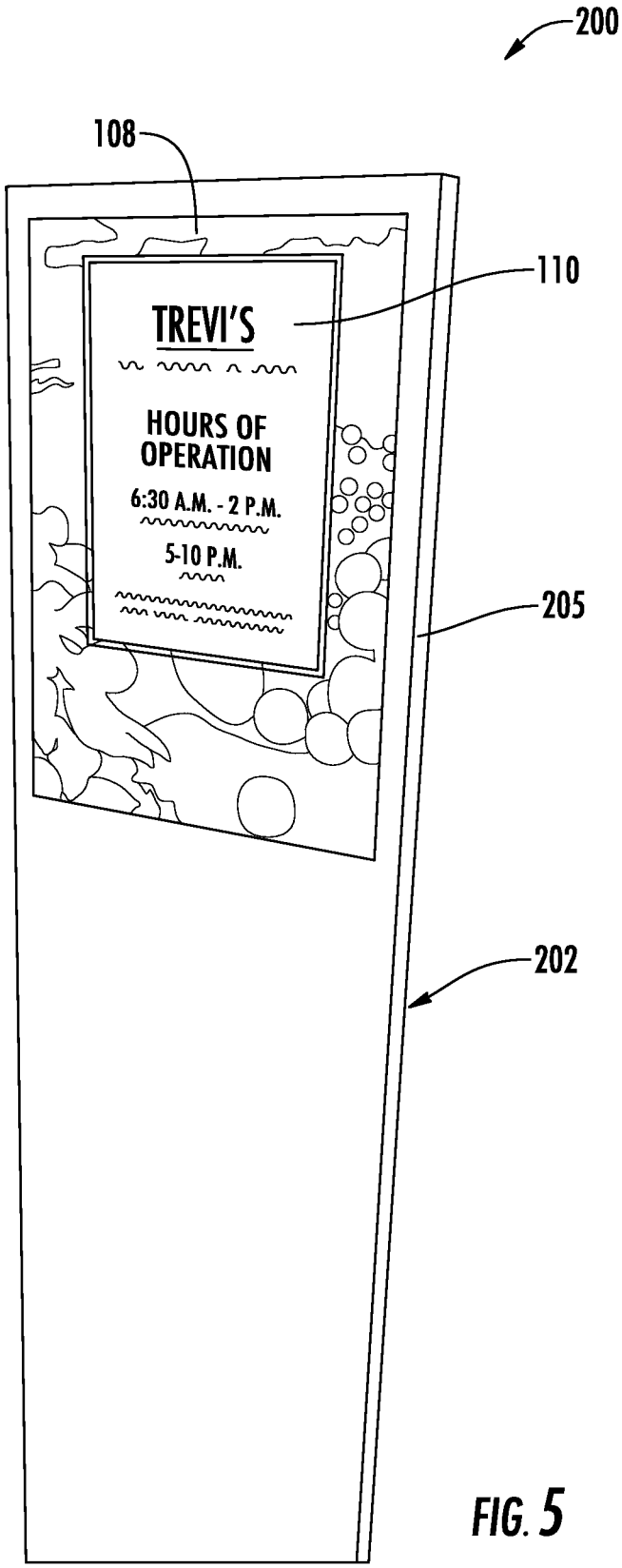
FIG. 5 is a perspective view of another particular aspect of a freestanding sign having a vertical orientation.

In another particular aspect of the invention, a freestanding sign 200 with an interchangeable magnetic panel 108 is shown in FIG. 5. Similar to the A-frame sign described above, the sign 200 includes a freestanding frame 205 and the magnetic panel 108 has a first polarity. A plate 120 secured to the first side 202 has a second polarity so that the magnetic panel 108 can be secured with magnetic forces as shown in FIG. 5. The magnetic panel 108 may also include a plastic sleeve 110 for receiving a piece of paper having information viewable through the sleeve 110. In addition, the magnetic panel 108 on the sign 200 is approximately at eye-height for a patron so that the advertising information of the magnetic panel 108 and the piece of paper within the sleeve 110 is viewed each time a person walks past the freestanding sign 200.

Figure 6:
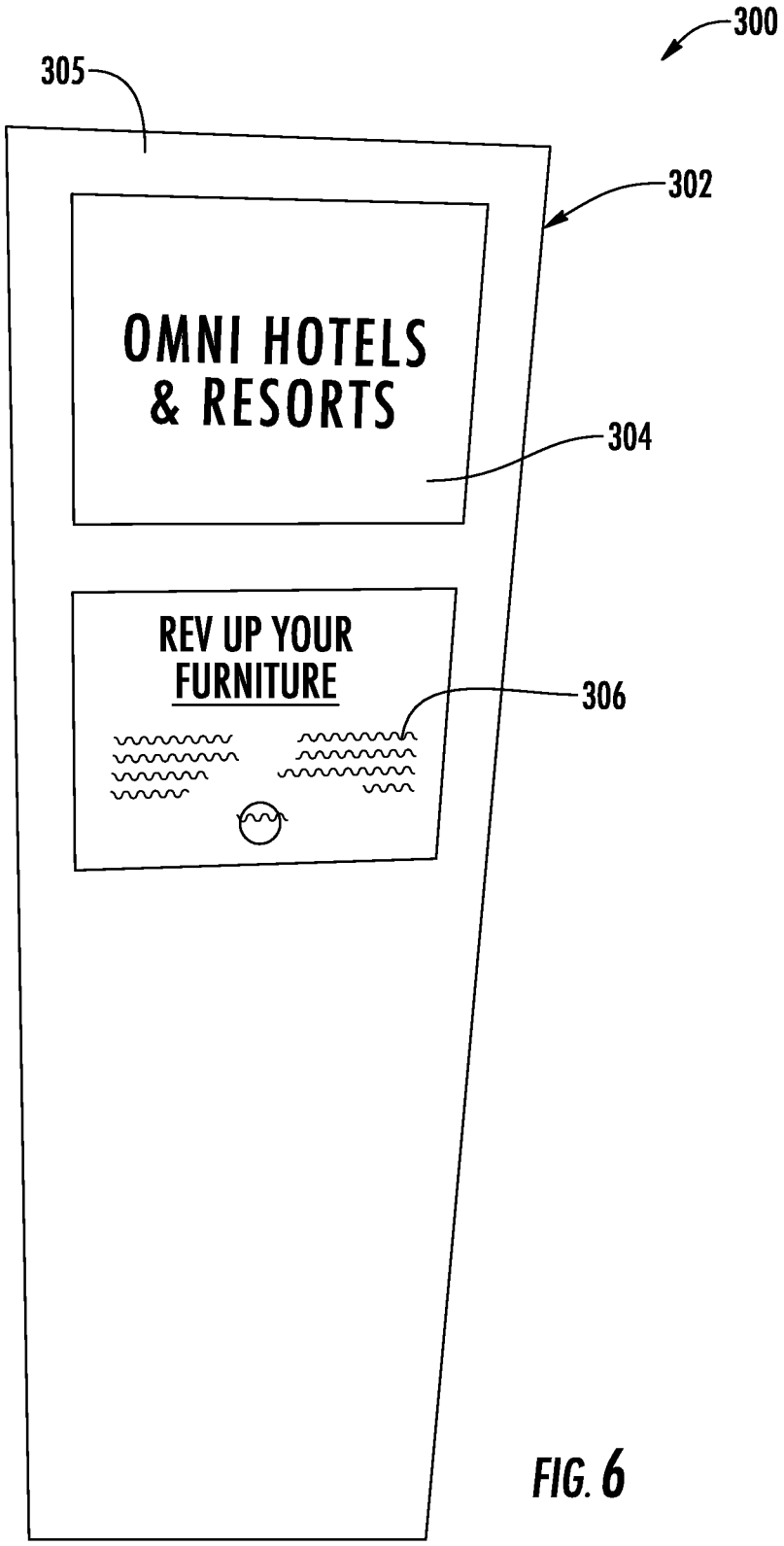
FIG. 6 is a perspective view of the freestanding sign of FIG. 5 having an interchangeable magnetic panel and plurality of advertisement panels on a first side.

In yet another particular illustrative embodiment, a first magnetic panel 304 is shown in FIG. 6 secured to a first side 302 of a freestanding sign 300 having a frame 305. In addition, a second magnetic panel 306 is also secured to the first side 302. Similar to the freestanding sign 200 shown in FIG. 5, this particular freestanding sign 300 can also be placed proximate to foot traffic patterns for increased visibility.

Figure 7:
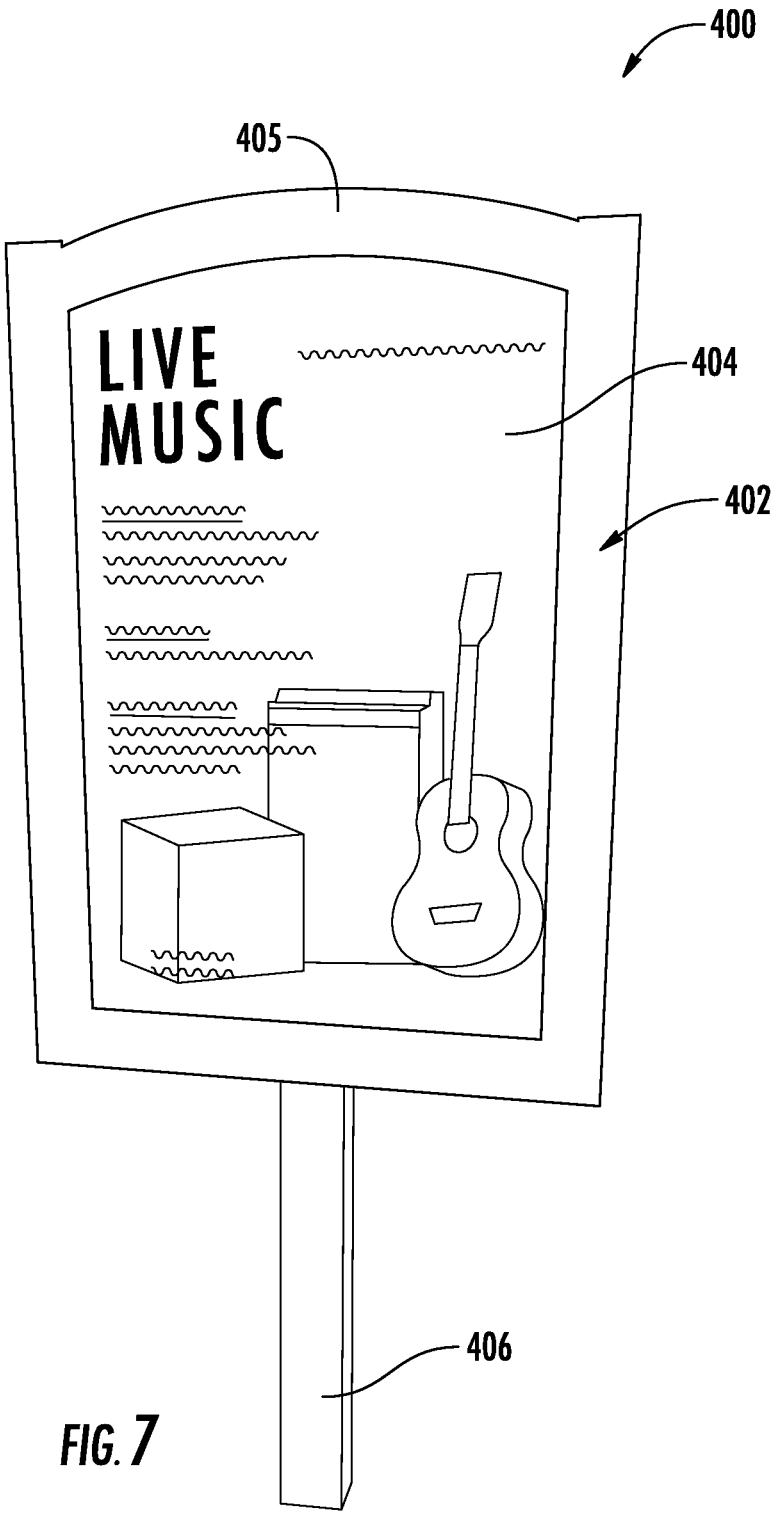
FIG. 7 is a perspective view of another particular aspect of the freestanding sign having a vertical support and installed outdoors on a ground surface.
Figure 8:
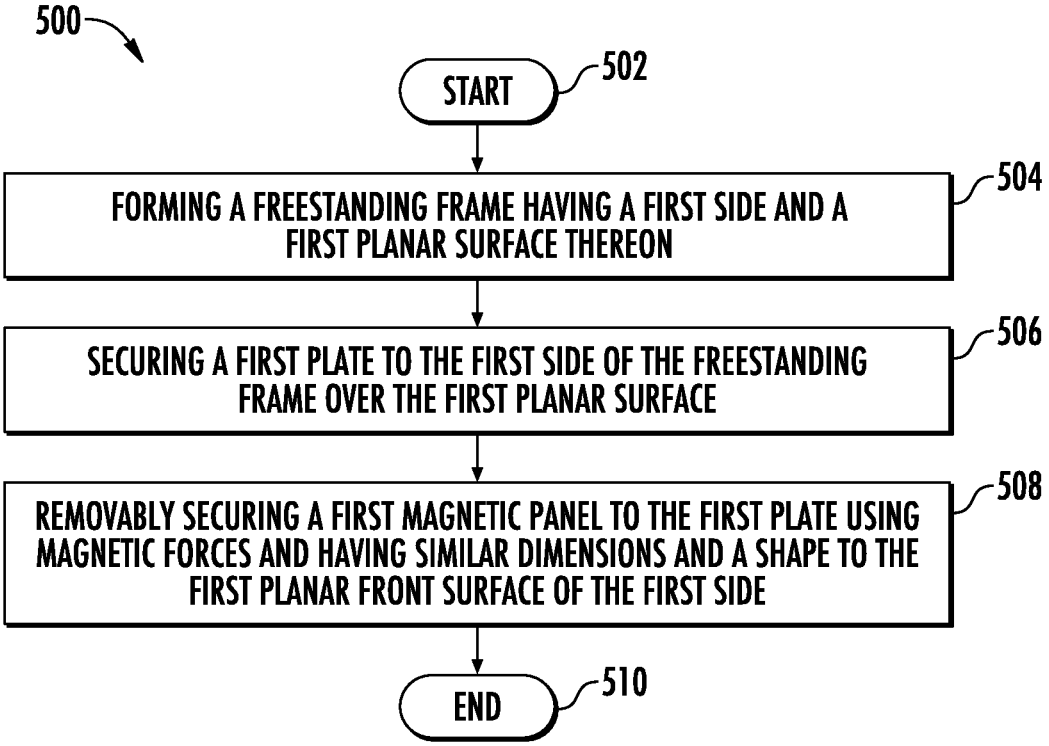
FIG. 8 is a flow chart of a method of making a sign for displaying advertising in accordance with another aspect of the invention.

Referring now to FIG. 7, another aspect of the invention includes the sign 400 installed using a post 406 on or into the ground. The sign 400 includes a frame 405 and a magnetic panel 404 on a first side 402 that is interchangeable. The magnetic panel 404 is secured to the first side 402 similar to that described above using magnetic forces and a steel plate integrated within the first side 402.

In yet another aspect of the invention, a method, 500, of making a sign for displaying advertising is disclosed. The method 500 begins, at 502, and includes forming a freestanding frame having a first side and a first planar surface thereon, at 504, and securing a first plate to the first side of the freestanding frame over the first planar surface, at 506. Moving to 508, the method includes removably securing a first magnetic panel to the first plate using magnetic forces and having similar dimensions and a shape to the first planar front surface of the first side.

The method 500 may also include forming a first protruding lip about a periphery of the first planar surface of the first side, and forming the freestanding frame having a second side and a second planar surface thereon. In addition, the method 500 may include forming a second protruding lip about a periphery of the second planar surface of the second side, securing a second plate to the second side of the freestanding frame over the second planar surface, and removably securing a second magnetic panel to the second plate using magnetic forces and having similar dimensions and a shape to the first planar front surface of the first side.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A sign for displaying advertising, the sign comprising:

a freestanding frame comprising a first side having a first planar surface, the first planar surface comprising a non-metallic material and having a protruding lip;

a first plate secured to the first side of the freestanding frame and over the first planar surface;

a first magnetic panel comprising a flexible material removably secured directly to the first plate using magnetic forces and having similar dimensions and a shape to the first planar front surface of the first side;

wherein the protruding lip is formed as a continuous solid part of the non-metallic material of the first planar surface and extending away from the first planar surface around an entire periphery of the first planar surface of the freestanding frame to provide a border along all sides of the first planar surface, wherein the protruding lip extends away from the first planar surface at least a distance of a combined thickness of the first plate and the first magnetic panel so that the first plate and the first magnetic panel are housed completely within the border and on all sides;

wherein the freestanding frame comprises a lower portion configured to support the sign in an upright orientation relative to a ground surface; and wherein the freestanding frame comprises a second side having a second planar surface, and the second side hingedly secured along a top edge to the first side forming an A-frame sign.

2. The sign of claim 1, wherein the first plate comprises steel.

3. The sign of claim 1, further comprising a second plate secured over the second planar surface of the second side.

4. The sign of claim 3, wherein the second plate comprises steel.

5. The sign of claim 4, further comprising a second protruding lip extending about a periphery of the second planar surface of the second side and around the second magnetic panel.

6. The sign of claim 3, further comprising a second magnetic panel comprising a flexible material and removably secured to the second plate using magnetic forces, wherein the second magnetic panel has similar dimensions and a shape to the second planar surface.

7. The sign of claim 1, wherein respective bottom edges of the first and second sides are configured to be spaced a distance apart causing the first and second magnetic panels to be displayed at an angle relative to the ground surface.

8. A sign for displaying advertising, the sign comprising:

a freestanding frame having a first side and a second side;

a first planar surface comprising a non-metallic material and having a first protruding lip, the first planar surface is positioned on the first side;

a first plate secured to the first side of the freestanding frame and over the first planar surface;

a first magnetic panel removably secured to the first plate using magnetic forces and having similar dimensions and a shape to the first planar front surface of the first side;

wherein the first protruding lip is formed as a continuous solid part of the non-metallic material of the first planar surface and extending away from the first planar surface around an entire periphery of the first planar surface of the freestanding frame to provide a first border along all sides of the first planar surface, wherein the first protruding lip extends away from the first planar surface at least a distance of a combined thickness of the first plate and the first magnetic panel so that the first plate and the first magnetic panel are housed completely within the first border and on all sides;

a second planar surface positioned on the second side of the freestanding frame; and a second plate secured to the second side of the freestanding frame and over the second planar surface.

9. The sign of claim 8, wherein the first plate comprises steel.

10. The sign of claim 8, wherein the second plate comprises steel.

11. The sign of claim 10, further comprising a second magnetic panel removably secured to the second plate using magnetic forces, wherein the second magnetic panel has similar dimensions and a shape to the second planar surface.

12. The sign of claim 11, further comprising a vertical support having a first end secured to a lower portion of the freestanding frame and configured to support the sign in an upright orientation relative to a ground surface.

13. A method of making a sign for displaying advertising, the method comprising:

forming a freestanding frame having a first side and a first planar surface thereon, the first planar surface comprising non-metallic material;

forming a protruding lip as a continuous solid part of the non-metallic material of the first planar surface and extending away from the first planar surface around an entire periphery of the first planar surface of the freestanding frame to provide a border along all sides of the first planar surface;

securing a first plate to the first side of the freestanding frame and over the first planar surface; and removably securing a first magnetic panel to the first plate using magnetic forces and having similar dimensions and a shape to the first planar front surface of the first side;

wherein the protruding lip extends away from the first planar surface at least a distance of a combined thickness of the first plate and the first magnetic panel so that the first plate and the first magnetic panel are housed completely within the border on all sides; and wherein the forming the freestanding frame comprises forming the freestanding frame having a second side and a second planar surface thereon.

14. The method of claim 13, further comprising forming a second protruding lip as part of the non-metallic material about a periphery of the second planar surface of the second side.

15. The method of claim 13, further comprising securing a second plate to the second side of the freestanding frame over the second planar surface; and removably securing a second magnetic panel to the second plate using magnetic forces and having similar dimensions and a shape to the second planar front surface of the second side.

* * * * *